US008287248B2

(12) United States Patent
Pillis et al.

(10) Patent No.: US 8,287,248 B2
(45) Date of Patent: Oct. 16, 2012

(54) COMPRESSOR

(75) Inventors: Joseph W. Pillis, Hagerstown, MD (US); Paul Nemit, Jr., Waynesboro, PA (US); Robert D. Heckman, Chambersburg, PA (US)

(73) Assignee: Johnson Controls Technology Company, Holland, MI (US)

( * ) Notice: Subject to any disclaimer, the term of this patent is extended or adjusted under 35 U.S.C. 154(b) by 412 days.

(21) Appl. No.: 12/646,765

(22) Filed: Dec. 23, 2009

(65) Prior Publication Data

US 2010/0158730 A1 Jun. 24, 2010

Related U.S. Application Data

(60) Provisional application No. 61/140,778, filed on Dec. 24, 2008.

(51) Int. Cl.
*F04B 49/00* (2006.01)
*F01C 1/16* (2006.01)
*F15B 13/16* (2006.01)

(52) U.S. Cl. ..... 417/213; 418/201.2; 91/390

(58) Field of Classification Search ..... 417/212, 417/213; 418/201.2; 91/374, 390; 251/62–63.6
See application file for complete search history.

(56) References Cited

U.S. PATENT DOCUMENTS

| | | | | |
|---|---|---|---|---|
| 3,432,089 | A * | 3/1969 | Schibbye | 418/88 |
| 4,222,716 | A * | 9/1980 | Shaw | 417/310 |
| 4,678,406 | A * | 7/1987 | Pillis et al. | 417/310 |
| 4,909,716 | A * | 3/1990 | Orosz et al. | 418/201.2 |
| 5,135,374 | A * | 8/1992 | Yoshimura et al. | 418/201.2 |
| 5,738,497 | A | 4/1998 | Hensley | |

* cited by examiner

*Primary Examiner* — Charles Freay
(74) *Attorney, Agent, or Firm* — McNees Wallace & Nurick LLC

(57) ABSTRACT

A system is provided for maintaining the position of a valve in a compressor. The valve includes a valve body connected to a piston in a cylinder by a shaft. The valve body is positioned in the discharge outlet of the compressor based on the location of the piston in the cylinder. The system maintains the position of the valve body in response to a movement of the piston by permitting fluid to flow from a fluid source through the piston and into a chamber of the cylinder to urge the piston back to its initial position in the cylinder.

18 Claims, 8 Drawing Sheets

COMPRESSOR

CROSS-REFERENCE TO RELATED APPLICATIONS

This application claims priority from and the benefit of U.S. Provisional Application No. 61/140,778, entitled COMPRESSOR, filed Dec. 24, 2008 which is hereby incorporated by reference.

BACKGROUND

The application generally relates to compressors for vapor compression systems. The application relates more specifically to a system to maintain the position of a valve in a positive-displacement compressor.

A vapor compression system includes a compressor that draws gas into a suction inlet, compresses the gas to increase the pressure of the gas, and then discharges the compressed gas at a discharge outlet. The compressed gas from the compressor then flows to another component of the system. The component to receive the compressed gas can be a pipeline, a storage container, a heat exchanger, or any other suitable component depending on the application of the vapor compression system. The gas used in the system can be a natural gas, for example, methane, ethane, propane, and butane; an industrial processing gas, for example, carbon dioxide, oxygen, nitrogen, helium, and argon; a refrigerant, for example, ammonia, carbon dioxide, or hydrofluorocarbon-based refrigerants (for example, R410A); and/or air.

In positive-displacement compressors, capacity control may be obtained by both speed modulation and suction throttling to reduce the volume of vapor or gas drawn into a compressor. Capacity control for a compressor can provide continuous modulation from 100% capacity to less than 10% capacity, good part-load efficiency, unloaded starting, and unchanged reliability. In some positive-displacement compressors, capacity can also be controlled by a slide valve employed in the compressor. The slide valve can be operated to remove a portion of the vapor from the compression chamber of the compressor, thereby controlling the capacity of the compressor. Besides the slide valve, other mechanical devices, such as slot valves and lift valves, may be employed in positive-displacement compressors to control capacity. Adjustments to capacity control valves or variable displacement mechanisms can meet the demands of the system. In a refrigeration system, capacity can be regulated based upon a temperature setpoint for the space being cooled. In other systems where the compressor is processing gas, capacity may be regulated to fully load the torque generator or prime mover (turbine or engine drive) for the compressor.

In natural gas applications, vapor compression systems can be used at the point the natural gas is recovered, for example, at the well head, and to maintain an appropriate level of pressure to maintain flow along the pipelines, for example, at a distance of about every 40 to 100 miles along a pipeline.

In some natural gas applications, the vapor compression system may be in a remote area. One problem with locating a vapor compression system in a remote area is that electrical power may be unavailable or difficult to generate. Furthermore, electrical power may not even be desired for natural gas applications (whether or not electrical power would be available) due to a risk of fire and/or explosion from the combustible fluid being worked and the possibility of sparks from the electrical connections, for example, solenoid valve connections. Thus, the efficiency of a remotely located vapor compression system may be reduced due to an inability to control the capacity of the compressor from a lack of electrical power.

SUMMARY

The present invention is directed to a compressor having an intake passage, a compression mechanism and a outlet passage in fluid communication. The compression mechanism is configured and positioned to receive a vapor from the intake passage and provide vapor at a higher pressure to the outlet passage. The compressor also includes a valve configured and positioned to adjust compressor capacity. The valve has a piston positioned in a cylinder and a valve body connected to the piston by a shaft. The piston divides the cylinder into a first chamber and a second chamber. The position of the piston in the cylinder corresponds to a desired compressor capacity. The shaft has an interior reservoir with an opening near the piston. The interior reservoir is configured and positioned to store a fluid. The valves further includes a system configured and positioned to permit the fluid from the interior reservoir of the shaft to flow into the first chamber to maintain the position of the piston in the cylinder.

The present invention is also directed to a valve for a compressor. The valve includes a valve body positionable in a discharge outlet of a compressor, a piston positioned in a cylinder, and a shaft connecting the valve body and the piston. The position of the valve body in the discharge outlet controls the capacity of the compressor. The piston divides the cylinder into a first chamber and a second chamber. The shaft has an interior reservoir with an opening near the piston. The interior reservoir is configured and positioned to store a fluid. A position of the valve body in the discharge outlet being controlled by a position of the piston in the cylinder. The valve further includes a bushing being positioned in the piston and a cylindrical rod. The rod slidably engaging the bushing and the interior reservoir of the shaft. The rod and bushing have a first orientation to prevent flow of fluid from the interior reservoir to the first chamber and the rod and bushing have a second orientation to enable flow of fluid from the interior reservoir to the first chamber to maintain the position of the piston in the cylinder.

DETAILED DESCRIPTION OF THE EXEMPLARY EMBODIMENTS

Figure 1:
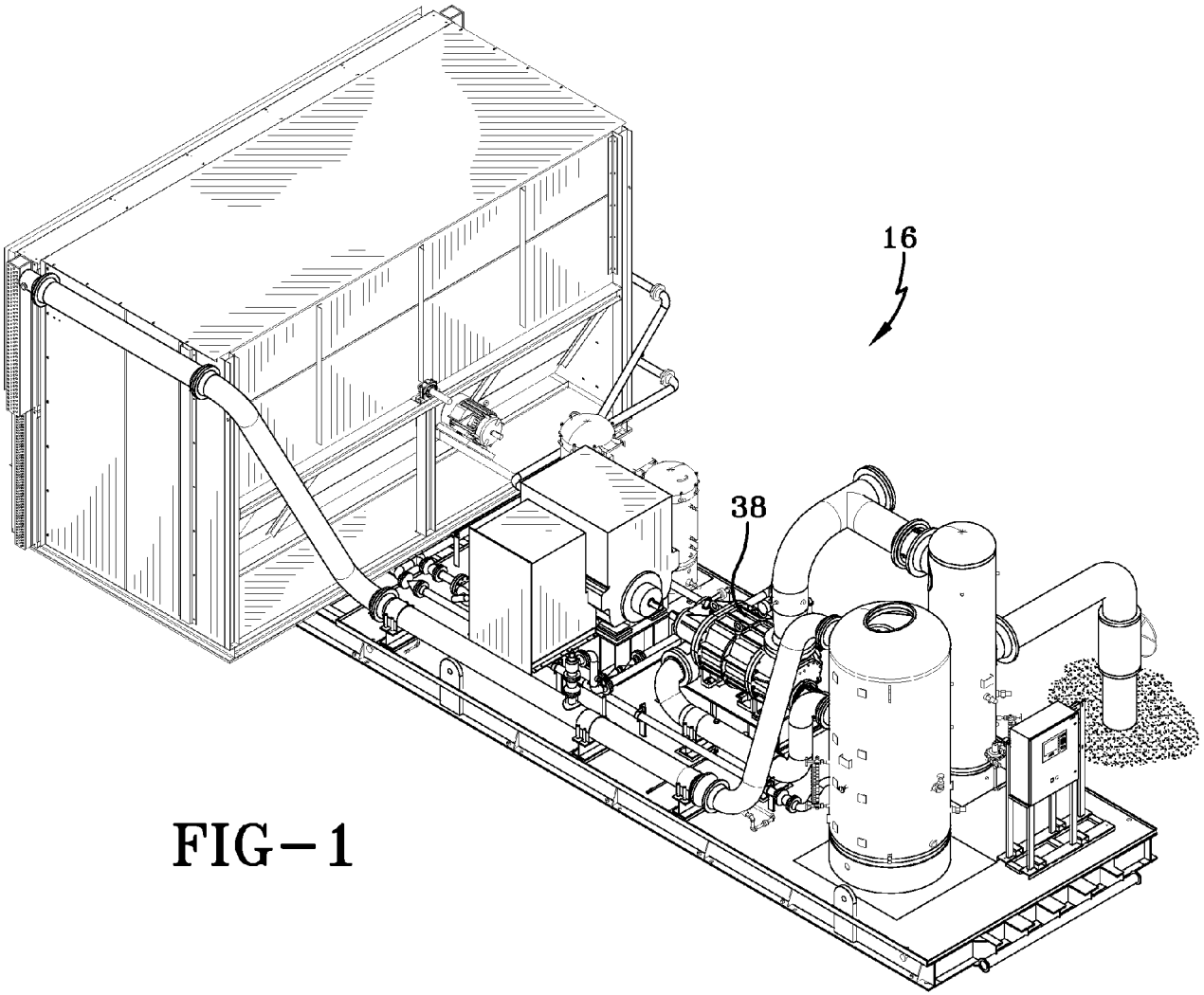
FIG. 1 shows an exemplary embodiment of a compressor in an industrial environment.

Referring to FIG. 1, an exemplary environment for a vapor compression system 16 is shown. In the exemplary environment, vapor compression system 16 is depicted as being used at a point where natural gas is recovered, for example, at a well head. The natural gas recovered and pressurized by vapor compression system 16 can be transported to and through a pipeline.

Figure 2:
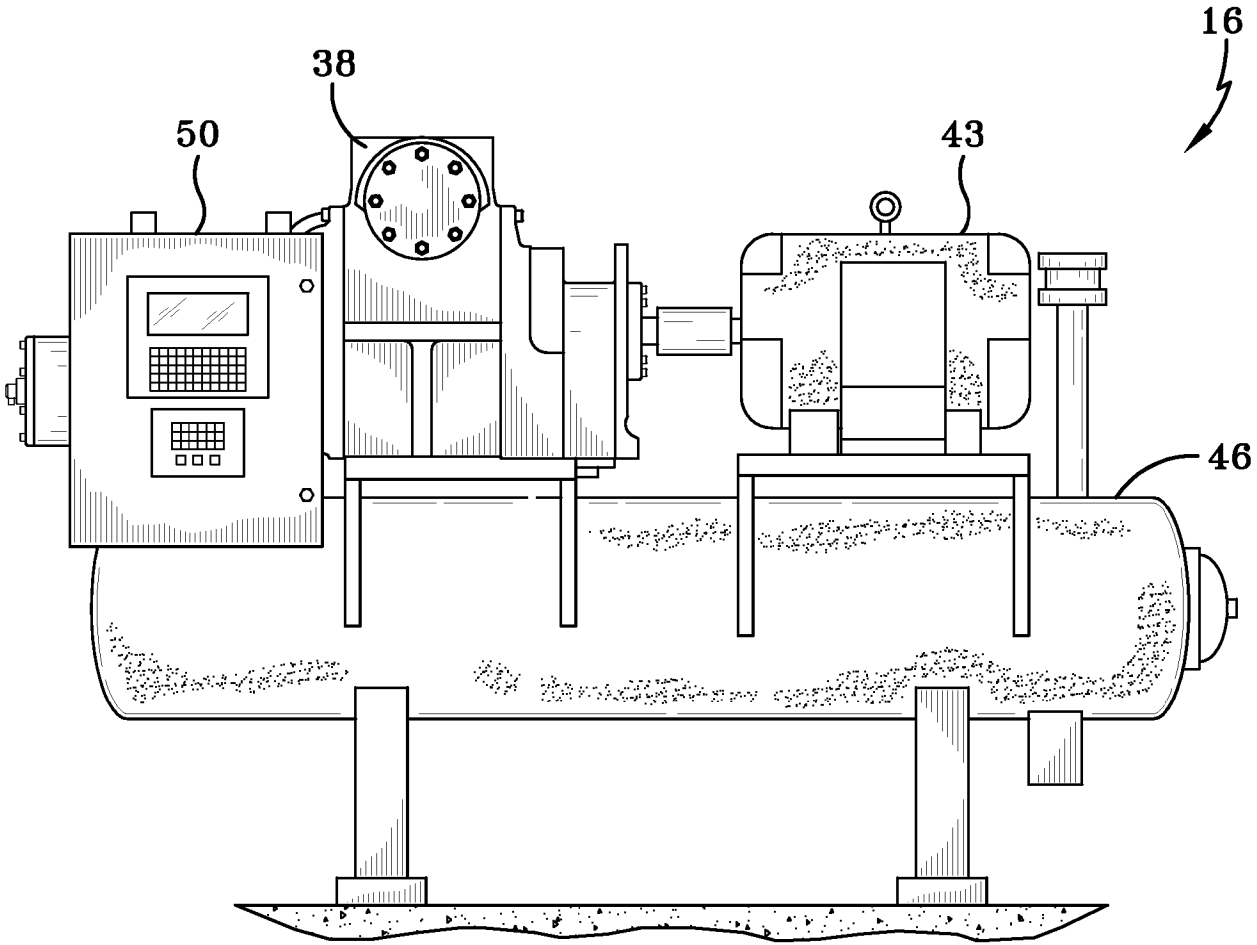
FIG. 2 shows an exemplary embodiment of a compressor in a packaged unit.

Referring to FIG. 2, vapor compression system 16 may include a compressor in a packaged unit. The packaged unit may include a screw compressor 38 and a torque generator or prime mover 43 to drive screw compressor 38. A control panel 50 to provide control instructions to the equipment can be included in the packaged unit. An oil separator 46 can be provided to remove entrained oil (used to lubricate the rotors of screw compressor 38) from the discharge vapor before providing the discharge vapor to its intended application. In vapor compression system 16, oil separator 46 can be in fluid communication with compressor 38. An oil and gas mixture can flow from compressor 38 to oil separator 46 where the oil is removed from the vapor. The separated oil in oil separator 46 can be returned to compressor 38 via an oil return line. The vapor flows from oil separator 46 to the desired application.

Torque generator or prime mover 43 can be a turbine powered by using a small portion of the natural gas, an electrical motor powered by electrical power, and/or an engine powered by combusting natural gas. In an exemplary embodiment, the capacity of system 16 may be controlled by adjusting the speed of torque generator or prime mover 43 driving compressor 38, using a variable speed drive (VSD). In another embodiment, system 16 can include additional circuits or compressors to provide additional capacity. The additional compressors, if used, can include any suitable type of compressor, for example, screw compressors, reciprocating compressors, scroll compressors, or rotary compressors.

Figure 3:
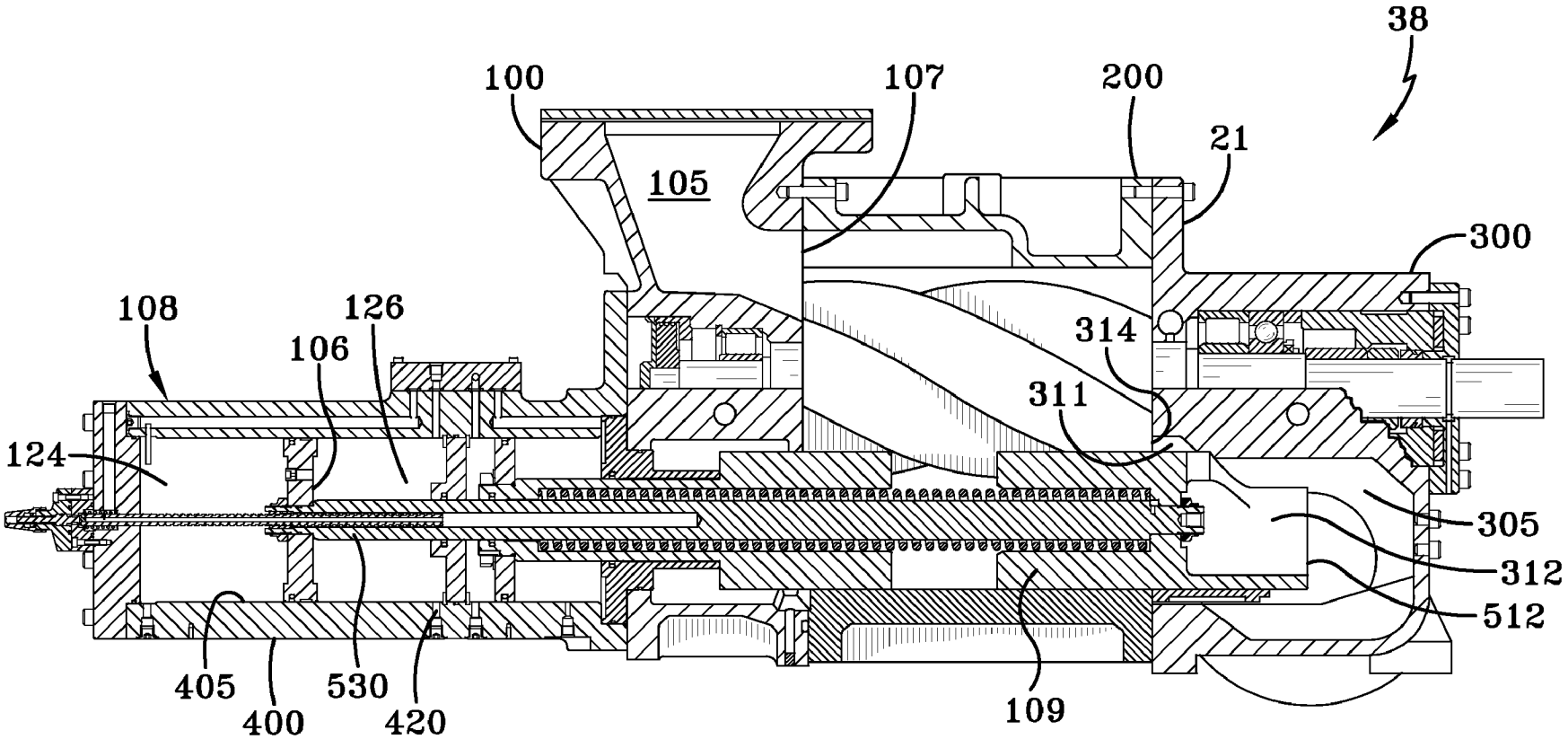
FIG. 3 shows a cross-sectional view of an exemplary embodiment of a compressor.

FIG. 3 shows a cross-sectional view of an exemplary embodiment of a screw compressor. Compressor 38 includes a compressor housing 21 that contains the working parts of compressor 38. Compressor housing 21 includes an intake housing 100, a rotor housing 200, a discharge housing 300, and a housing 400. Compressor 38 compresses a vapor and delivers the compressed vapor to a desired application through a discharge line.

Vapor is directed to an intake passage 105 of compressor 38. Exemplary sources for providing vapor to intake passage 105 include a pipeline, a container, a processing facility, a heat exchanger, and a well head. Torque generator or prime mover 43 may be connected to rotors of compressor 38 by a drive shaft. The rotors of compressor 38 can matingly engage with each other via intermeshing lands and grooves. Each of the rotors of compressor 38 can revolve in a cylinder within rotor housing 200.

Vapor flows from intake passage 105 and enters rotor housing 200 at a suction port 107. The vapor then enters compression pockets defined between the surfaces of the rotors of compressor 38. As the rotors of compressor 38 engage one another, compression pockets between the rotors of compressor 38, also referred to as lobes, are reduced in size and are axially displaced to a discharge side of compressor 38. The compressed vapor is discharged into a discharge passage 305 of discharge housing 300. The compressed vapor eventually exits compressor 38 for its intended application.

Figure 4:
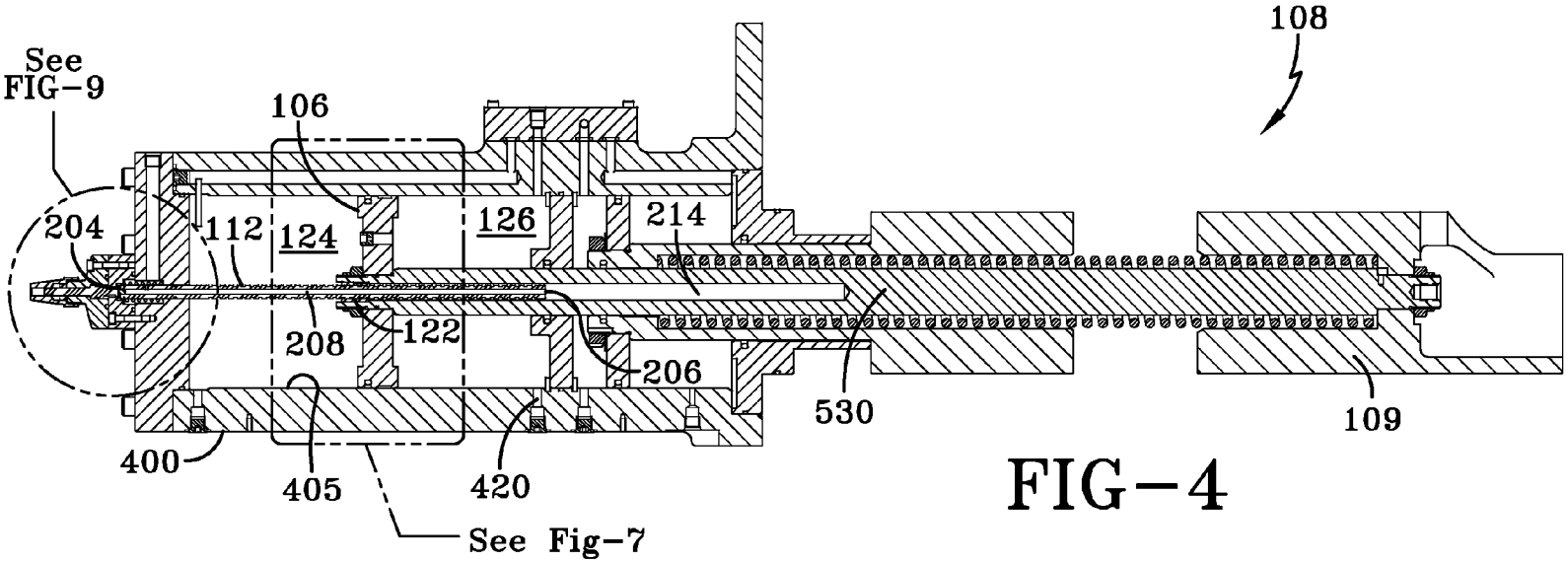
FIG. 4 shows a cross-sectional view of an exemplary embodiment of a slide valve.

Referring to FIGS. 3 and 4, compressor 38 includes slide valve assembly 108 which can be used to control the capacity of compressor 38. Slide valve assembly 108 includes valve body 109 and a piston 106 rigidly connected to one another by a shaft 530. Valve body 109 forms a portion of the boundary of rotor housing 200, and provides the ability to adjust the amount of the rotor threads exposed to a discharge port 311 of compressor 38. Compressed vapor exits rotors of compressor 38 into discharge passage 305 at discharge port 311. Discharge port 311 has two portions, the first being a radial portion 312 formed by a discharge end 512 of valve body 109 and the second being an axial portion 314 formed by discharge housing 300. The geometry of rotor housing 200 provides for the size of radial portion 312 to be controlled by the position of valve body 109.

Slide valve assembly 108 can be adjusted to control the position of slide valve body 109 relative to the rotors of compressor 38 by fluid pressure applied to piston 106. Piston 106 is contained in a cylinder 405 of housing 400 and is configured to divide cylinder 405 into two distinct chambers, one chamber on either side of piston 106. Piston 106 divides cylinder 405 into a first chamber 124 and a second chamber 126. First chamber 124 and second chamber 126 are connected by a passage 128 (see FIGS. 7 and 8) through piston 106. Piston 106 can be displaced in cylinder 405 by applying fluid pressure to either side of piston 106 and thereby move valve body 109 axially to increase or decrease compressor 38 capacity. Over time, piston 106 may drift within cylinder 405 resulting in movement of the position of valve body 109. The drift of piston 106 may occur due to loss of fluid in one of the chambers, gas in the oil, and/or small leakages across the seals and result in a reduction or increase of capacity for compressor 38 due to a change from the desired operating conditions and to the position of valve body 109. The potential reduction or increase in capacity loss in efficiency from the drifting of piston 106 may be avoided by maintaining the position of piston 106 in chamber 405 and thus preventing a change in the capacity of compressor 38.

To unload compressor 38, piston 106 is moved in cylinder 405 to move valve body 109 toward discharge port 311. The position of valve body 109 toward discharge port 311 places valve body 109 in an unloaded position and reveals a recirculation port for vapor to return to intake passage 105. To load compressor 38, fluid pressure is introduced into cylinder 405 through an opening 420 to move piston 106 and thereby move valve body 109 away from discharge port 311. The position of valve body 109 away from discharge port 311 closes the recirculation port and places valve body 109 in the fully loaded position. To partially load or unload compressor 38, fluid pressure can move piston 106 and the recirculation port can be partially opened or closed by valve body 109. In an exemplary embodiment, the position of piston 106 can be set by balancing the fluid pressures in chambers 124, 126 after piston 106 is in a desired position. Valves, for example, hand valves, can be used to control the fluid inlet and outlet connections for chambers 124, 126.

Piston 106 is designed to slide freely in cylinder 405 without permitting fluid to flow around piston 106. A seal can be provided to prevent fluid leakage around piston 106. Piston 106 may be protected from discharge pulses without the need to provide any seals or other non-integral pieces on shaft 530 of slide valve assembly 108 or attached to compressor housing 21.

Referring to FIG. 4, slide valve assembly 108 is configured to control capacity of compressor 38 in response to the position of piston 106 within cylinder 405. A rod 112 has a passageway to permit fluid flow from a corresponding pressurized fluid source (not shown) through rod 112 and into a small reservoir in shaft 530. In an exemplary embodiment, the fluid source is external of housing 400. In another exemplary embodiment, fluid source can be inside housing 400. To have an internal fluid source, an internal enclosure containing the fluid must be used. In response to a movement of piston 106 toward the fully loaded position, pressurized fluid from the reservoir in shaft 530 can provide a fluid force to selectably urge piston 106 back to its original position in housing 400. In an exemplary embodiment, in response to a movement of piston 106 away from the fully loaded position, lower pressure fluid from the reservoir in shaft 530 can provide a fluid force to selectably pull piston 106 back to its original position in housing 400. The use of the corresponding pressurized fluid in the reservoir of shaft 530 to respond to movement of piston 106 allows the operational capacity of the compressor to be maintained at a desired point.

Figure 5:
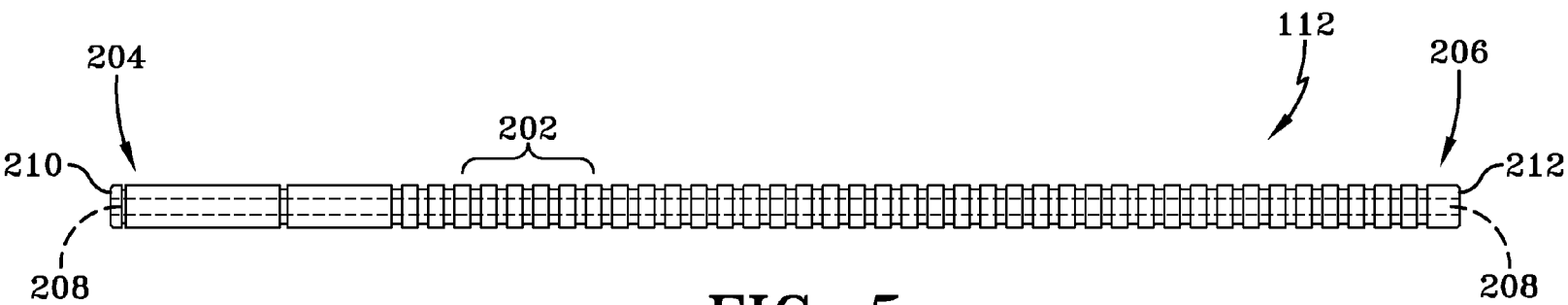
FIG. 5 shows an exemplary embodiment of a rod of the slide valve of FIG. 4.

Referring to FIG. 5, rod 112 includes a region 202 of varying cross-sectional areas or diameters between a first end 204 and a second end 206 of rod 112. Rod 112 further includes an internal channel 208 extending though the length of rod 112. First opening 210 at first end 204 of rod 112 is near the pressurized fluid source. Second opening 212 at second end 206 of rod 112 is in a hollow area or reservoir 214 (see FIG. 4) of shaft 530 connecting piston 106 and valve body 109. A bushing 122 can be used to seal one end of reservoir 214. Fluid can enter internal channel 208 at first end 204 and exit internal channel 208 at second end 206. In one exemplary embodiment, fluid can enter internal channel 208 at second end 206 and exit internal channel 208 at first end 204. In another exemplary embodiment, fluid can enter internal channel 208 closer to first end 204 than second end 206 and exit internal channel 208 closer to second end 206 than first end 204. In a further exemplary embodiment, fluid can enter internal channel 208 closer to second end 206 and exit internal channel 208 closer to first end 204. In another exemplary embodiment, fluid can enter and exit internal channel 208 by combining the previous embodiments.

Figure 6B:
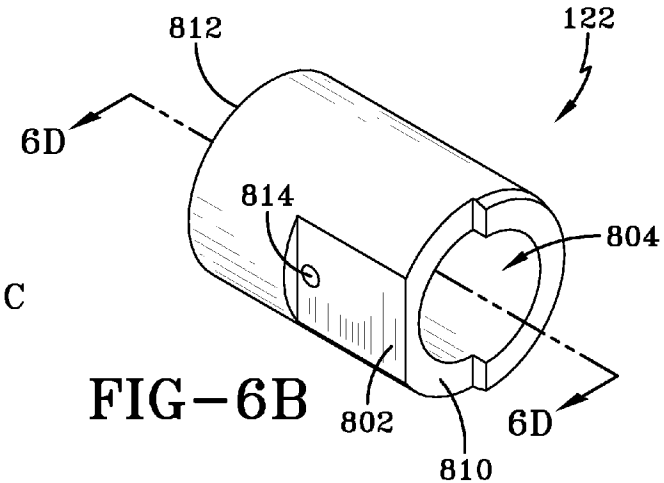
FIGS. 6A, 6B, 6C, and 6D show different views and cross-sections of an exemplary embodiment of a bushing of the slide valve of FIG. 4.
Figure 6D:
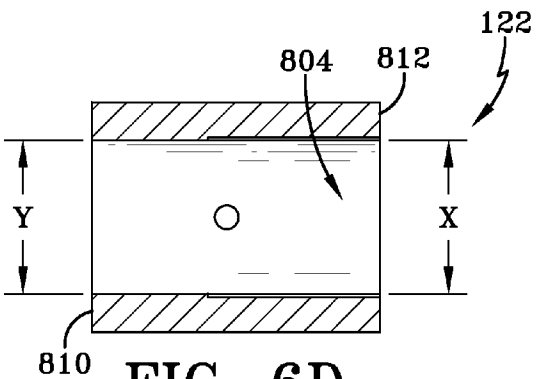
Figure 6A:
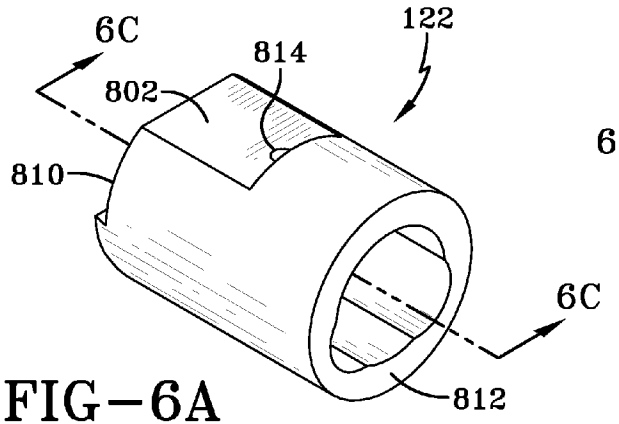
Figure 6C:
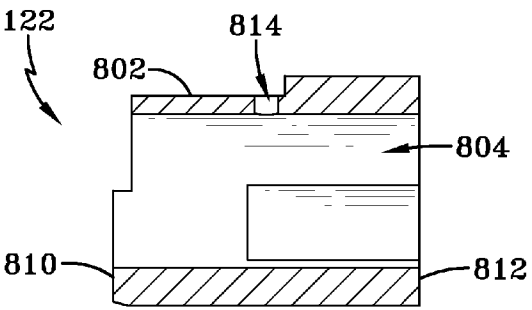
Figure 7:
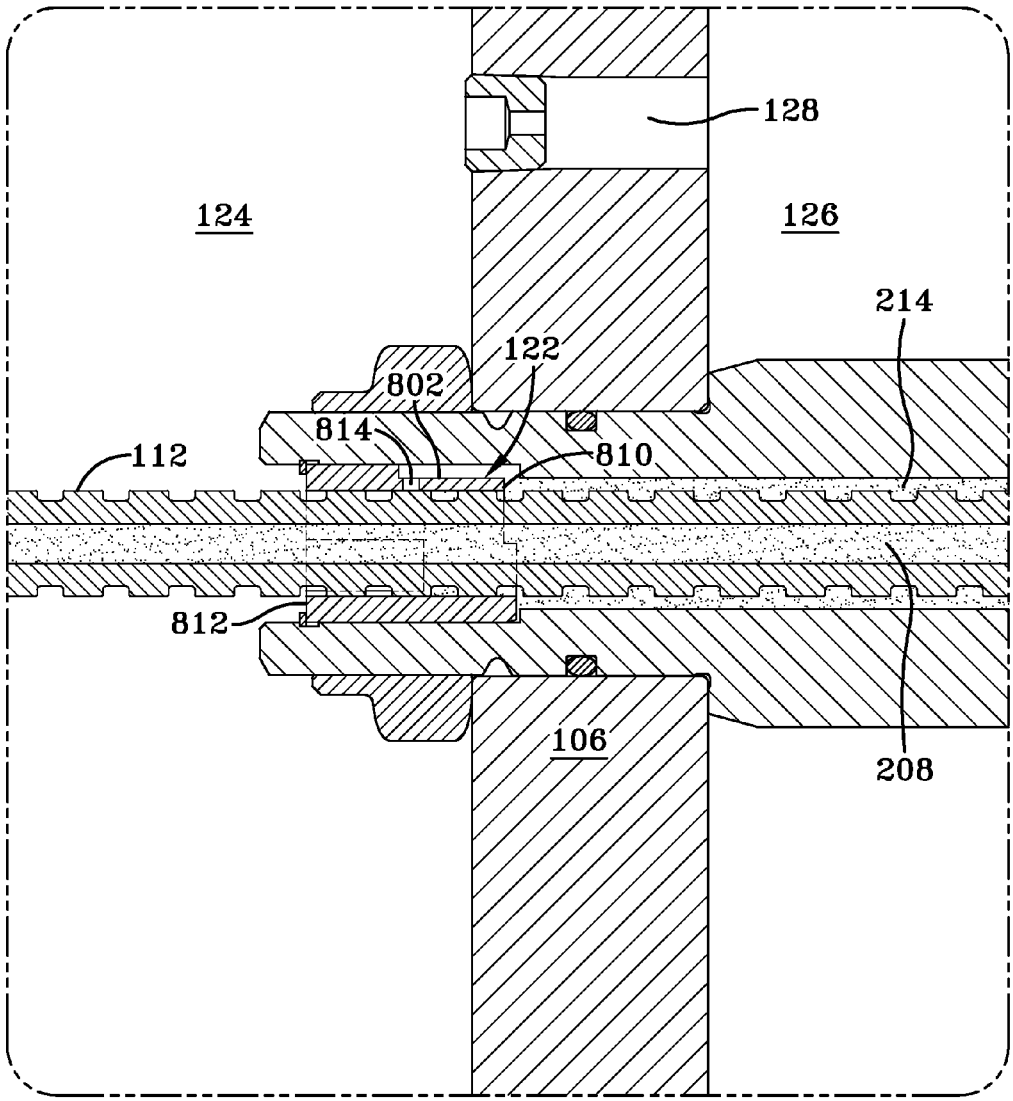
FIG. 7 shows an enlarged view of an exemplary embodiment of the piston of the slide valve of FIG. 4 with a closed flow path.

Referring to FIGS. 6A, 6B, 6C, and 6D, bushing 122 includes a surface 802 and an internal portion 804. As shown in FIGS. 6B and 6C, surface 802 includes an aperture 814 in fluid communication with internal portion 804. Internal portion 804 of bushing 122, begins at a first end 810 of bushing 122 with a diameter Y (see FIG. 6D) that is smaller than a diameter X (see FIG. 6D) of internal portion 804 at a second end 812 of bushing 122. In an exemplary embodiment, the interior cross-sectional area of first end 810 is less than the interior cross-sectional area of second end 812. In another exemplary embodiment, one or more channels can be formed into internal portion 804 at second end 812 of bushing 122. Depending upon the position of rod 112 and aperture 814, fluid may flow from reservoir 214 to first chamber 124 of cylinder 400. Referring to FIG. 7, rod 112 slidably fits within bushing 122 and region 202 of rod 112 extends through bushing 122. The larger cross sectional areas or diameters of region 202 of rod 112 can substantially close or seal aperture 814 when the largest cross sectional areas or diameters of region 202 are aligned with aperture 814. In an exemplary embodiment, the larger cross sectional areas or diameters of region 202 of rod 112 can slidably engage with internal portion 804 of bushing 122 with a diameter Y to form a substantially fluid-tight seal.

Figure 8:
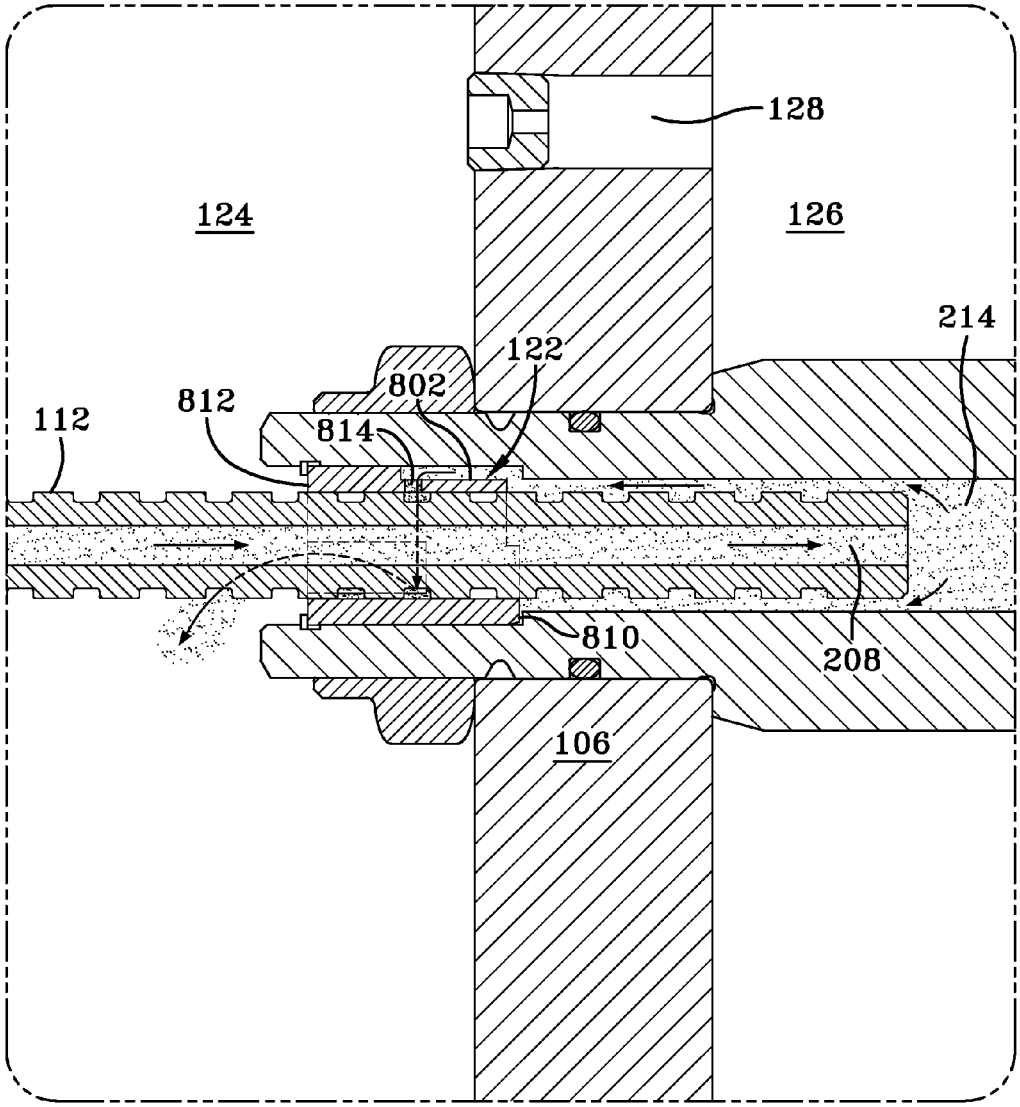
FIG. 8 shows an enlarged view of an exemplary embodiment of the piston of the slide valve of FIG. 7 with an open flow path.

The arrangement of rod 112, bushing 122, and reservoir 214 can maintain the position of piston 106 at a desired location. If piston 106 drifts toward seal cap 116, thereby adjusting the capacity of compressor 38, then bushing 122 (and piston 106) slides along rod 112 and, as shown in FIG. 8, a flow path is opened for fluid in reservoir 214. When bushing 122 slides along rod 112, aperture 814 can be aligned with narrower or smaller cross sectional areas or diameters of region 202 on rod 112. When aperture 814 is aligned with the narrower cross-sectional area or diameter of rod 112, a flow path permitting fluid from the reservoir 214 to travel to chamber 124 is opened. In an exemplary embodiment, the fluid can flow from reservoir 214 along surface 802 of bushing 122 into aperture 814 (see FIG. 8). The fluid can then flow around the narrower cross-sectional area or diameter of rod 112 into the space between rod 112 and internal portion 804 of bushing 122 with diameter X and into chamber 124. In a further exemplary embodiment, the fluid can flow from aperture 814 into the one or more channels formed into internal portion 804 at second end 812 of bushing 122.

In another exemplary embodiment, bushing 122 can be positioned in piston 106 opposite to the position shown in FIGS. 7 and 8, i.e., surface 810 of bushing 122 can be near chamber 124. Fluid can flow from reservoir 214 between rod 112 and bushing 122 in the space between rod 112 and internal portion 804 of bushing 122 with diameter X. In a further exemplary embodiment, the fluid can flow in the one or more channels formed into internal portion 804 at second end 812 of bushing 122. The fluid can then flow around the narrower cross-sectional area or diameter of rod 112 and through aperture 814 to chamber 124.

When the fluid travels to chamber 124, the pressure in chamber 124 increases, thereby urging piston 106 away from seal cap 116. Fluid can also travel through passage 128 to chamber 126. When piston 106 is urged back to the desired location, the flow path is then closed from reservoir 214 by a larger diameter portion of region 202 as shown in FIG. 7. Thus, the capacity of compressor 38 may be maintained by positioning and/or repositioning piston 106 at a desired location.

Figure 9:
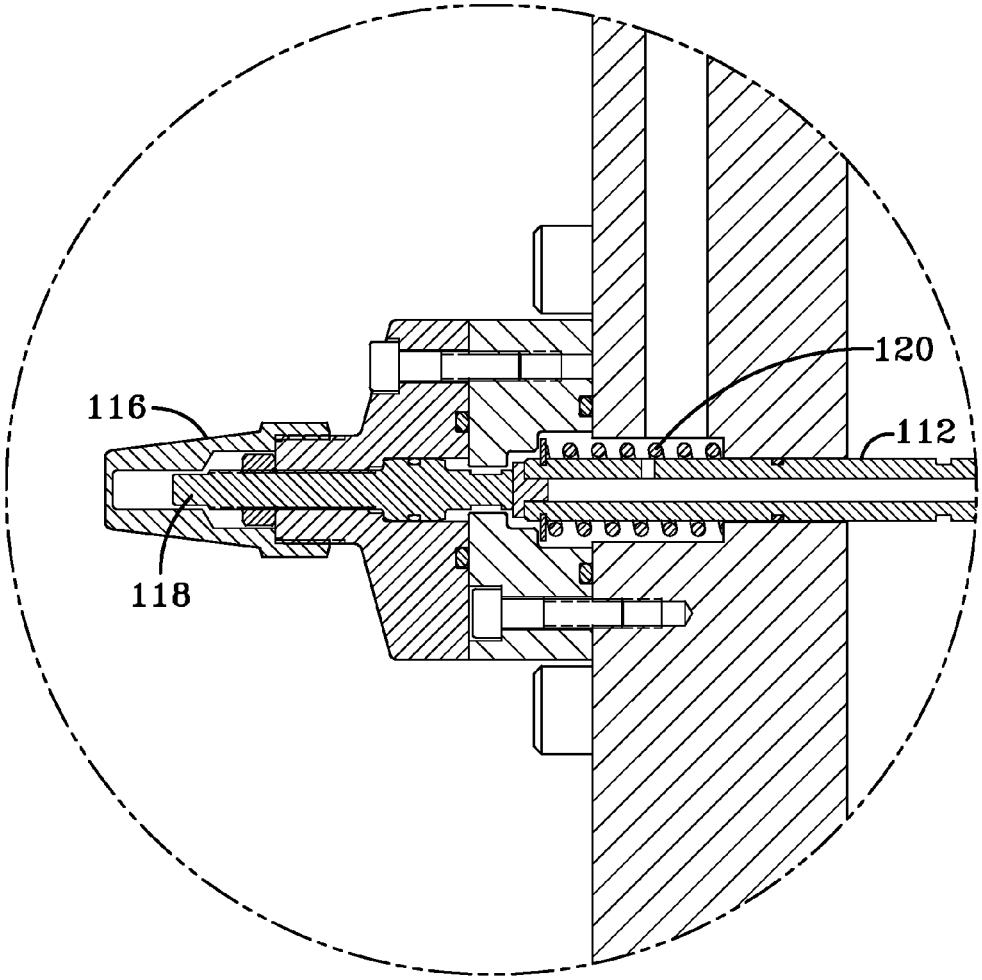
FIG. 9 shows an enlarged view of an exemplary embodiment of a seal cap of the slide valve of FIG. 4.

Referring to FIG. 9, upon removal of seal cap 116, a bolt 118 with an interior thread (not shown) can be adjusted. The adjustment of bolt 118 allows rod 112 to move axially. In an exemplary embodiment, upon rotation of bolt 118, rod 112 moves axially compressing a spring 120. Spring 120 provides an opposing force against the force provided by adjusting bolt 118 with rotation. The opposing force provides fine adjustment capability for rod 112. The ability to adjust rod 112 axially permits the initial positioning of piston 106 at a desired location. By manually adjusting rod 112 to close the flow path when piston 106 is in the desired location, rod 112 and bushing 122 can be configured to open upon axial movement of piston 106, thereby permitting the pressurized fluid to reposition piston 106 to a desired location.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

an intake passage, a compression mechanism and a outlet passage in fluid communication;

the compression mechanism being configured and positioned to receive a vapor from the intake passage and provide vapor at a higher pressure to the outlet passage;

a valve configured and positioned to adjust compressor capacity, the valve comprising:

a piston positioned in a cylinder, the piston dividing the cylinder into a first chamber and a second chamber, and a position of the piston in the cylinder corresponding to a desired compressor capacity;

a valve body connected to the piston by a shaft, the shaft comprising an interior reservoir having an opening near the piston, and the interior reservoir being configured and positioned to store a fluid; and a system configured and positioned to permit the fluid from the interior reservoir of the shaft to flow into the first chamber to maintain the position of the piston in the cylinder, the system comprising:

a cylindrical member, the member being positioned in the piston;

a cylindrical rod, the rod slidably engaging the member and the interior reservoir of the shaft the rod and member having a first orientation to prevent flow of fluid from the interior reservoir to the first chamber and the rod and member having a second orientation to enable flow of fluid from the interior reservoir to the first chamber;

the rod and member being positioned in the second orientation in response to movement of the piston in the cylinder;

the rod comprising an internal passageway for fluid from a fluid source to the interior reservoir of the shaft;

the member comprising an aperture configured and positioned to provide fluid communication between an exterior portion of the member and an interior portion of the member; and the second orientation of the rod and member being configured to permit fluid to flow from the interior reservoir through the aperture to the first chamber.

2. The compressor of claim 1 wherein the member has a first end opposite the shaft and a second end near the shaft, the first end having a first interior diameter and the second end having a second interior diameter less than the first interior diameter.

3. The compressor of claim 2 wherein the first end of the member comprises a channel in the interior portion of the member, the channel extending toward the second end of the member.

4. The compressor of claim 2 wherein the rod comprises a first region having a first exterior diameter and a second region having a second exterior diameter greater than the first exterior diameter.

5. The compressor of claim 4 wherein the first orientation of the rod and member has the second region of the rod near the aperture and the second orientation of the rod and member has the first region of the rod near the aperture.

6. The compressor of claim 5 wherein the first region of the rod is configured and positioned to permit fluid flow through the aperture and around the first region in response to the rod and member being in the second orientation.

7. The compressor of claim 5 wherein the second region of the rod is configured and positioned to substantial seal the aperture in response to the rod and member being in the first orientation.

8. The compressor of claim 1 wherein the piston comprises a passageway, the passageway being configured and position to permit fluid flow between the first chamber and the second chamber.

9. A compressor comprising:

an intake passage, a compression mechanism and a outlet passage in fluid communication;

the compression mechanism being configured and positioned to receive a vapor from the intake passage and provide vapor at a higher pressure to the outlet passage;

a valve configured and positioned to adjust compressor capacity, the valve comprising:

a piston positioned in a cylinder, the piston dividing the cylinder into a first chamber and a second chamber, and a position of the piston in the cylinder corresponding to a desired compressor capacity;

a valve body connected to the piston by a shaft, the shaft comprising an interior reservoir having an opening near the piston, and the interior reservoir being configured and positioned to store a fluid; and a system configured and positioned to permit the fluid from the interior reservoir of the shaft to flow into the first chamber to maintain the position of the piston in the cylinder, the system comprises:

a cylindrical member, the member being positioned in the piston;

a cylindrical rod, the rod slidably engaging the member and the interior reservoir of the shaft;

the rod and member having a first orientation to prevent flow of fluid from the interior reservoir to the first chamber and the rod and member having a second orientation to enable flow of fluid from the interior reservoir to the first chamber;

the rod and member being positioned in the second orientation in response to movement of the piston in the cylinder; and a bolt to axially adjust a position of the rod relative to the member.

10. A valve for a compressor comprising:

a valve body positionable in a discharge outlet of a compressor, the position of the valve body in the discharge outlet controlling capacity of the compressor;

a piston positioned in a cylinder, the piston dividing the cylinder into a first chamber and a second chamber;

a shaft connecting the valve body and the piston, the shaft comprising an interior reservoir having an opening near the piston, and the interior reservoir being configured and positioned to store a fluid;

a position of the valve body in the discharge outlet being controlled by a position of the piston in the cylinder;

a bushing being positioned in the piston;

a cylindrical rod, the rod slidably engaging the bushing and the interior reservoir of the shaft;

the rod and bushing having a first orientation to prevent flow of fluid from the interior reservoir to the first chamber and the rod and bushing having a second orientation to enable flow of fluid from the interior reservoir to the first chamber to maintain the position of the piston in the cylinder.

11. The valve of claim 10 wherein:

the rod comprising an internal passageway for fluid from a fluid source to the interior reservoir of the shaft;

the bushing comprising an aperture configured and positioned to provide fluid communication between an exterior portion of the bushing and an interior portion of the bushing; and the second orientation of the rod and bushing being configured to permit fluid to flow from the interior reservoir through the aperture to the first chamber.

12. The valve of claim 11 wherein the bushing has a first end opposite the shaft and a second end near the shaft, the first end having a first interior diameter and the second end having a second interior diameter less than the first interior diameter.

13. The valve of claim 12 wherein the first end of the bushing comprises a channel in the interior portion of the bushing, the channel extending toward the second end of the bushing.

14. The valve of claim 12 wherein the rod comprises a first region having a first exterior diameter and a second region having a second exterior diameter greater than the first exterior diameter.

15. The valve of claim 14 wherein the first orientation of the rod and bushing has the second region of the rod near the aperture and the second orientation of the rod and bushing has the first region of the rod near the aperture.

16. The valve of claim 15 wherein the first region of the rod is configured and positioned to permit fluid flow through the aperture and around the first region in response to the rod and bushing being in the second orientation.

17. The valve of claim 15 wherein the second region of the rod is configured and positioned to substantial seal the aperture in response to the rod and bushing being in the first orientation.

18. The valve of claim 10 further comprises a bolt to axially adjust a position of the rod relative to the bushing.

* * * * *